US006178661B1

(12) United States Patent
Müller et al.

(10) Patent No.: US 6,178,661 B1
(45) Date of Patent: Jan. 30, 2001

(54) STEAM BLOWER BOX

(75) Inventors: Dieter Müller, Sontheim; Erich Grundler, Nattheim, both of (DE)

(73) Assignee: Voith Sulzer Papiertechnik Patent GmbH, Heidenheim (DE)

( * ) Notice: Under 35 U.S.C. 154(b), the term of this patent shall be extended for 0 days.

(21) Appl. No.: 09/304,850

(22) Filed: May 5, 1999

(51) Int. Cl.[7] ..... F26B 3/00
(52) U.S. Cl. ..... 34/487; 34/638
(58) Field of Search ..... 34/443, 444, 448, 34/451, 463, 465, 487, 114, 119, 122, 124, 130, 629, 638, 639, 640

(56) References Cited

U.S. PATENT DOCUMENTS 5,749,158 5/1998 Muller et al. .

FOREIGN PATENT DOCUMENTS 4401220 6/1995 (DE) .
4402278 7/1995 (DE) .
29809466 9/1998 (DE) .
96/22420 7/1996 (WO) .

*Primary Examiner*—Pamela Wilson
*Assistant Examiner*—Michelle A. Mattera
(74) *Attorney, Agent, or Firm*—Greenblum & Bernstein, P.L.C.

(57) ABSTRACT

Steam blower box for the application of steam onto a paper or cardboard web, the steam blower box connected to a plurality of steam lines. The steam lines are routed to at least one support plate, where the steam lines are each to be attached to a supply line connected to the steam source. The supply lines are equipped with connecting nipples, each having a stop, and the support plate has openings into which the connecting nipples can be inserted from one side of the support plate. The supply lines are locked down to the support plate by at least one retaining strip which works in conjunction with the stops and is movable behind the stops.

30 Claims, 9 Drawing Sheets

STEAM BLOWER BOX

CROSS-REFERENCE TO RELATED APPLICATIONS

The present application claims priority under 35 U.S.C. § 119 of German Patent Application No. 298 09 466.5, filed on May 26, 1998, the disclosure of which is expressly incorporated by reference herein in its entirety.

BACKGROUND OF THE INVENTION

1. Field of the Invention

The invention relates to a steam blower box for the application of steam onto a material web passing by, and more particularly, a material web such as a paper or cardboard web that is to be dewatered and is passing through the press section of a paper-making machine.

2. Description of Background Information

A conventional steam blower box extends over the entire web width of a material web passing through the press section of a paper-making machine, transverse to the web travel direction. The steam blower box includes a plurality of zone chambers that are arranged side by side over the width of the web and are connected to a steam source by individual control valves. Each zone chamber is connected to a steam line, and the steam lines are routed to at least one support plate, where the steam lines are each attached to a supply line connected to the steam source.

A steam blower box of this nature is used primarily in paper manufacturing. Its purpose is to raise the temperature of the material web by means of the steam applied to the material web, in order to improve dewatering of the material web. In the process, the steam blower box offers the possibility of influencing the transverse moisture profile of the material web by the sectional application of steam.

Such a steam blower box is known, for example from German Patent Nos. DE 44 02 278 A1 and DE 44 01 220 C1. In these known steam blower boxes, the supply lines are combined in groups on supply plates, which are joined to the support plate by quick clamping elements. The quick clamping elements facilitate rapid decoupling when an individual steam blower box is removed.

SUMMARY OF THE INVENTION

In view of the shortcomings of the prior art, an object of the invention is to provide a steam blower box in which the supply lines can be detachably fastened to the supply plate in an especially simple and reliable manner.

According to one aspect of the present invention, a steam blower box for the application of steam onto a material web to be dewatered passing through a press section of a paper-making machine, includes a blower box extending, transverse to a web travel direction of the material web, over the entire width of the material web, the blower box comprising a plurality of zone chambers, arranged side by side over the width of the web, and connected to a plurality of steam lines, the plurality of steam lines to be connected to a corresponding plurality of supply lines connected to a steam source. A connecting nipple having a stop is provided to each of the supply lines at the end to be connected to the steam lines, and a support plate to which the plurality of steam lines is routed. The support plate has openings formed therein into which the connecting nipples can be inserted from one side of the support plate until the stops contact the plate, while the steam lines connect to the openings on a remaining side of the plate. At least one retaining strip works in conjunction with the stops to lock down the supply lines to the support plate, the retaining strip or strips being movable parallel to the support plate behind the stops, so that the stops are held on the one side of the plate by the retaining strip or strips. The material web may be one of a paper web or a cardboard web.

That is, the supply lines are locked down to the support plate by at least one retaining strip, which works in conjunction with the stops, and is movable parallel to the support plate behind the stops so that the stops are held on the relevant side of the plate by the retaining strip.

Optionally, the retaining strip is tapered on a front end in a direction of motion thereof. If the retaining strip is tapered on its front end in the direction of its motion, a guide surface is created that acts together with the stops, by means of which the relevant connecting nipples are, if necessary, pushed further into the openings. More particularly, with the taper, before the connecting nipples are locked down on the support plate by the retaining strip, the relevant connecting nipples may be pushed further into the openings until the stops make contact with the support plate.

Further optionally, at least some of the openings provided in the support plate are arranged in a row or rows of openings, the retaining strip being movable laterally along the row of openings. The connecting nipples inserted in the row(s) of openings are locked down to the support plate by the retaining strip or strips movable laterally along the row(s) of openings. A retaining strip can thus lock several supply lines down to the support plate.

In this case, in one variation, each row or rows of openings may be arranged with an adjacent row of openings, the adjacent row parallel to the aforementioned row or rows, and the retaining strip or strips are moved in steps along the adjacent row of openings such that the connecting nipples associated with the adjacent row of openings are inserted one after another into sequential openings of the adjacent row, and locked down to the support plate by the retaining strip as the retaining strip is pushed along.

In another alternative variation, the openings provided in the support plate are arranged in a plurality of parallel rows and a plurality of retaining strips are provided. Each of the retaining strips is movable laterally along the row of openings, and the connecting nipples inserted in the row of openings are locked down to the support plate by the plurality of retaining strips, each movable laterally along the plurality of parallel rows of openings.

In this case, each of the plurality of retaining strips may be moved laterally between adjacent rows of the plurality of parallel openings. At least one of the retaining strips may act together with the stops of corresponding connecting nipples inserted into two adjacent parallel rows of openings to lock corresponding connecting nipples, inserted into both of two adjacent parallel rows of openings, down to the support plate. In other words, retaining strips provided between adjacent rows of openings can act together with the stops of connecting nipples inserted into one row of openings as well as with the stops of the connecting nipples inserted into another, adjacent row of openings in order to lock the relevant connecting nipples down to the support plate.

Further, there may be two outermost retaining strips, one of the two outermost retaining strips being moved laterally outside each outermost row of the plurality of parallel openings. That is, at least one retaining strip, that can be moved parallel to the rows of openings, is provided laterally outside each of the outermost rows of openings, as well as between adjacent rows of openings. Accordingly, the individual retaining strips can be moved in steps in such a way that the connecting nipples associated with each adjacent row of openings can be inserted one after another into sequential openings of this row and locked down to the support plate by the relevant retaining strip as it is pushed along. For this purpose it is useful for an outer row of openings to be filled initially with connecting nipples which, at first, are only locked down to the support plate by the relevant outer retaining strip. While the second row of openings is being filled, another retaining strip is pushed in, which then serves to lock the connecting nipples in both adjacent rows of openings.

Optionally, each of the plurality of retaining strips are moved into respective locking positions from the same side of the support plate. However, it is also possible to use retaining strips that are pushed in from opposite sides of the support plate, that is, one or more retaining strips is moved into a respective locking position from one side of the support plate, and one or more remaining retaining strips is moved into a respective locking position from another, opposite side of the support plate.

Advantageously, the support plate includes a guiding mechanism that guides the plurality of retaining strips on the support plate. In this case, the guide mechanism may include a plurality of guide elements arranged one behind the other in the direction of motion of the plurality of retaining strips, and each of the plurality of retaining strips is guided by the plurality of guide elements. Further, the plurality of guide elements may located between each pair of openings in sequence along the direction of motion of the plurality of retaining strips.

In other words, several guide elements can be arranged on the support plate, one behind the other in the direction of the retaining strips' motion, in which case one such guide element is advantageously located between each pair of sequential openings intended for the connecting nipples. Each of the plurality of guide elements may include a crosspiece, each crosspiece extending perpendicularly to the direction of motion of the plurality of retaining strips and parallel to each remaining crosspiece, and each crosspiece having a plurality of guide openings formed therein, each guide opening being aligned with corresponding guide openings in the remaining crosspieces in the direction of motion of the plurality of retaining strips. That is, the guide openings are aligned with one another in the direction in which the relevant retaining strips move.

In one specific structure, each stop of the connecting nipples is formed as a ring flange surrounding a corresponding connecting nipple. In this manner, specifically, the stops can work together with two retaining strips located on opposite sides of the relevant connecting nipple. In another specific structure, each connecting nipple is provided with at least one O-ring for sealing each connecting nipple in a corresponding opening. In this case, before the nipples are inserted in the relevant openings, it is advisable for the O-rings to be greased.

In one particular modification of the invention, the support plate is substantially horizontally oriented and the connecting nipples are inserted into the openings from an underside of the support plate.

Each of the supply lines may include a flexible hose, so that the supply lines can be routed easily, and more particularly, the supply lines may include flexible hoses hanging downwardly. In this case, each flexible hose may be provided along at least a portion of a length thereof with a braided covering. In order to retain maximum flexibility, for example in the vicinity of the support plate, such a braided covering can be provided starting a certain distance away from the support plate.

The supply lines, at ends facing away from the support plate, may be connected to a steam distribution station having control valves, or a control valve station, controlling an amount of steam to each supply line.

Advantageously, the retaining strip or strips are secured, by a screw and a safety plate, to the support plate in their final positions, i.e., in a position securing the connecting nipples inserted in all of the openings.

In a typical configuration, the support plate extends away from one end of the steam blower box to a position outside of the paper-making machine. In this manner, such support plates can be provided on both ends of paper-making machine. However, an appropriate support plate can also be placed in another location.

In another aspect of the present invention, a steam blower box, for the application of steam onto a material web, has a plurality of steam lines to be connected to a corresponding plurality of supply lines connected to a steam source. The steam blower box includes a support plate having a first and second surface, the support plate having openings formed therein arranged in rows and columns, the number of openings corresponding to the number of steam lines and the number of supply lines, and each of the steam lines being connected to a corresponding opening on the first surface of the support plate. A plurality of guide members extend in a direction of the columns of openings, each guide member having a plurality of sliding guides formed therethrough. The plurality of sliding guides of each guide member are aligned along a direction of the rows of openings. A connecting nipple is provided to each of the supply lines, each connecting nipple being insertable into the openings from the second surface of the support plate, and each connecting nipple has a flange stop formed thereon. A plurality of retaining strips hold the flange stops of the connecting nipples against the second surface of the support plate, and thereby hold the connecting nipples in the openings from the second surface of the support plate. Each retaining strip corresponds to a sliding guide and is slidable in the direction of the rows of openings, into the aligned sliding guides, through the plurality of guide members.

In this aspect of the invention, each of the plurality of retaining strips may hold a plurality of flange stops of the connecting nipples against the second surface of the support plate, the number of the flange stops held by each of the plurality of retaining strips being determined by an amount of sliding in the direction of the rows of openings.

Optionally, one or more of the retaining strips hold flange stops of the connecting nipples on both sides of the retaining strip in the direction of the columns of openings.

Moreover, each of the plurality of retaining strips may be slidable into the aligned sliding guides through the plurality of guide members in the direction of the rows of openings from a same side of the support plate. Alternatively, at least one retaining strip may be slidable into the aligned sliding guides through the guide members in the direction of the rows of openings from one side of the support plate, while at least one remaining retaining strip is slidable into the aligned sliding guides through the plurality of guide members in the direction of the rows of openings from another, opposite side of the support plate.

In still another aspect of the present invention, in which supply lines are connected to rows of openings in a support plate of a steam blower box, a connecting nipple of each supply line is inserted into an opening in a row of openings until the flange stop of the connecting nipple contacts a surface of the support plate. The retaining strip is then slid parallel to the row of openings and parallel to the surface of the support plate behind the flange stop to lock the connecting nipple against the support plate. A next connecting nipple of a next supply line is again inserted in a next opening in the row until a flange stop of the next connecting nipple contacts the surface of the support plate, and the retaining strip is further slid behind the flange stop of the next connecting nipple to lock the next connecting nipple against the support plate. The inserting of a next connecting nipple and the sliding of the retaining strip are repeated, in stepwise fashion, until all of the openings in the row of openings are filled with connecting nipples locked against the support plate by the retaining strip.

In this case, at least one retaining strip may be slid between two adjacent parallel rows of openings with connecting nipples inserted therein so that the retaining strip locks the connecting nipples against the support plate in both of the two adjacent parallel rows of openings. Further, a plurality of retaining strips may be slid along two sides of every row of a plurality of parallel rows of openings with connecting nipples inserted therein so that the retaining strips lock the connecting nipples against the support plate on two sides of every row.

BRIEF DESCRIPTION OF THE DRAWINGS

The present invention is further described in the detailed description which follows, in reference to drawings by way of non-limiting examples of exemplary embodiments of the present invention, in which like reference numerals represent similar parts throughout the drawings, and wherein.

DETAILED DESCRIPTION OF THE INVENTION

The particulars shown herein are by way of example and for purposes of illustrative discussion of the embodiments of the present invention only, and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
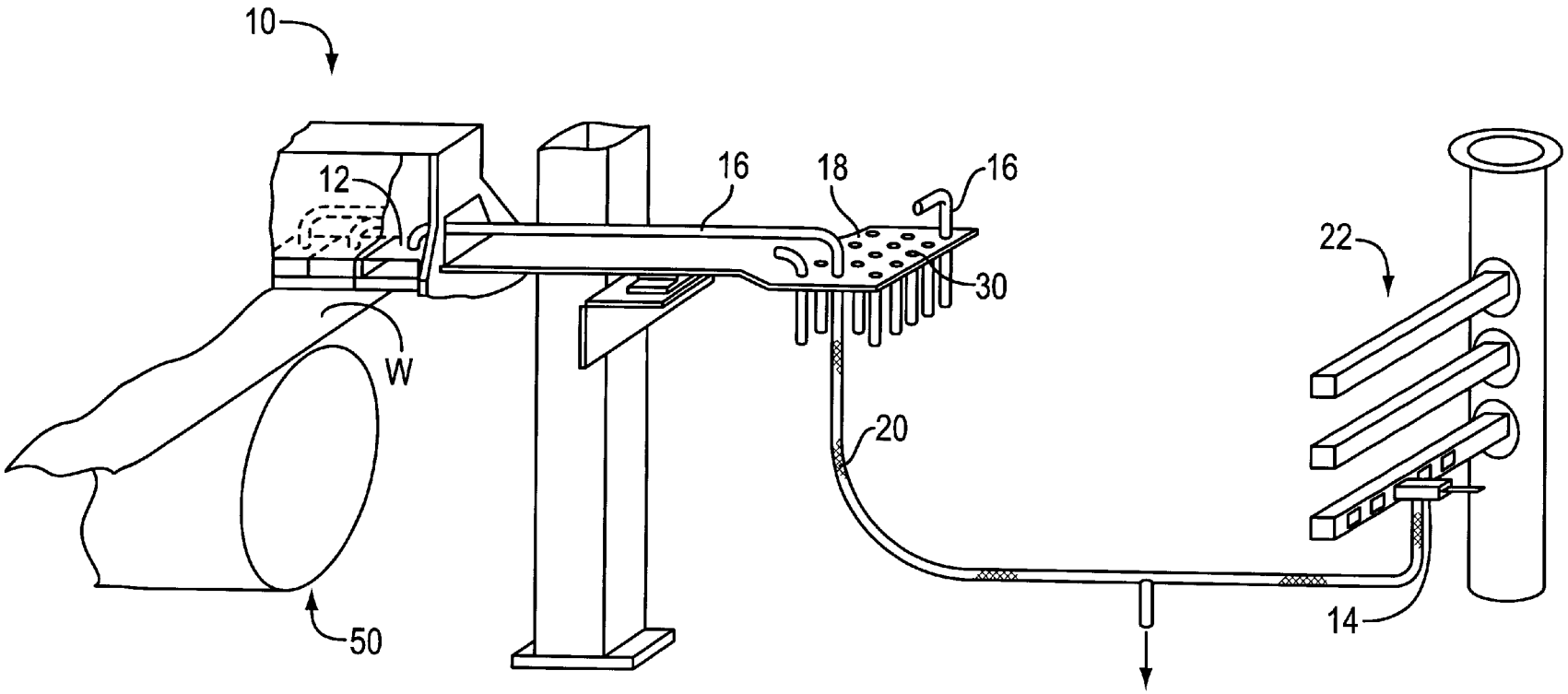
FIG. 1 shows a schematic partial representation of a steam blower box with an associated support plate, as well as a material web and schematic depiction of the press-section of a paper-making machine.

FIG. 1 schematically shows a steam blower box 10 for the application of steam onto a material web W passing by. The material web W may be a paper or cardboard web to be dewatered and passing through the press section of a paper-making machine 50.

A blower box portion of the steam blower box 10 extends, transverse to the web travel direction, over the entire width of the web W and comprises a plurality of zone chambers 12 arranged side by side over the width of the web W. Each zone chamber 12 is connected to a steam line 16. The steam lines 16 are routed to a support plate 18, where each steam lines 16 is to be attached to a corresponding supply line 20 that is connected to the steam source. Accordingly, the steam lines 16 connected to the zone chambers 12 are to be connected to a steam source (e.g., a control valve station 22) by individual control valves 14. That is, the steam blower box 10 for the application of steam onto a material web W has a plurality of steam lines 16 to be connected to a corresponding plurality of supply lines 20, which are, in turn, connected to a steam source (e.g., control valve station 22).

In the embodiment shown in FIG. 1, the support plate 18 extends from one end of the steam blower box 10 to a region outside of the relevant paper-making machine 50 (e.g., a portion of which extends below the zone chambers 12). In this manner, such support plates 18 can be provided on both ends of paper-making machine 50. However, an appropriate support plate 18 can also be placed in another location.

As shown in FIG. 1, in the depicted embodiment, the support plate 18 is essentially horizontal in orientation. At the ends facing away from the support plate 18, the supply lines 20 (and corresponding connecting nipples 24, described below) are connected to the support plate 18 from the underside, and subsequently hang downward and are routed to a steam distribution station having control valves 14 or a control valve station 22.

Figure 2:
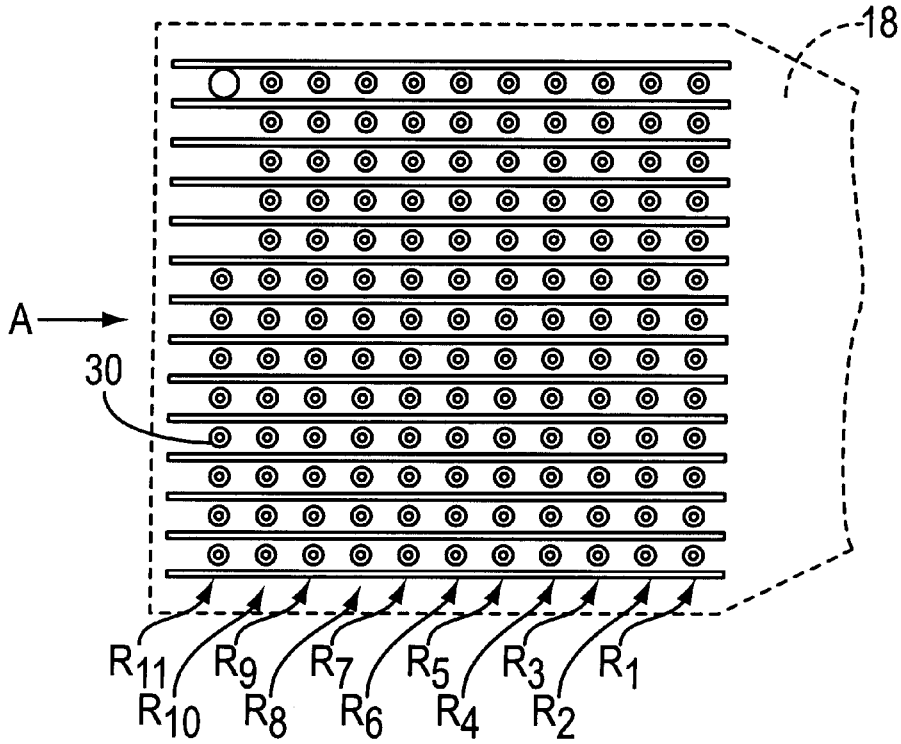
FIG. 2 shows a schematic top view of the support plate of FIG. 1.

The support plate 18 is provided with openings or bores 30 formed therein, which, in the present embodiment, are arranged in eleven parallel rows $R_1$–$R_{11}$. In FIG. 2, the rows $R_1$–$R_{11}$ are sequentially numbered from right to left.

In the present embodiment, thirteen openings 30 are provided in each row $R_i$ of openings 30, except in the left-hand row of openings $R_{11}$. The openings 30 of each row $R_i$ of openings are provided in columns at an equal distance from one another. Moreover, the eleven rows of openings $R_1$–$R_{11}$ are also arranged at an equal distance from one another, with the openings 30 aligned with one another in the manner shown in FIG. 2.

Figure 3:
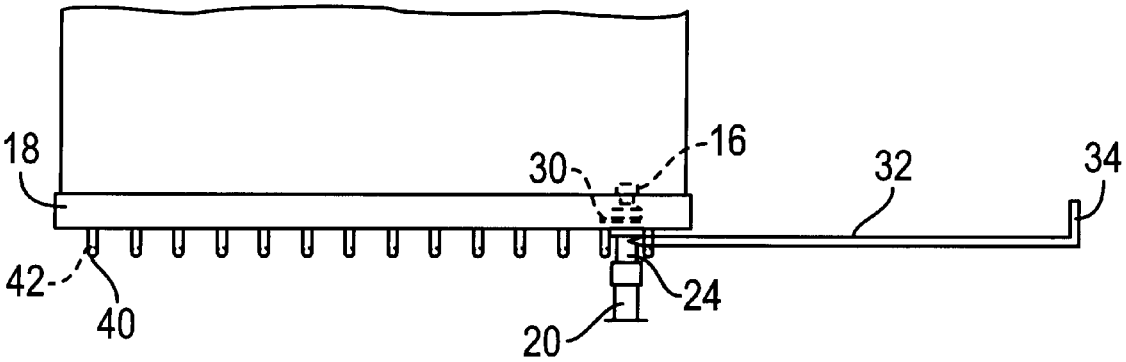
FIG. 3 shows a schematic side view of the support plate in the direction of Arrow A in FIG. 2, wherein a first supply line, having a connecting nipple is inserted in the first opening of the support plate's first row of openings, is locked down to the support plate.
Figure 4:
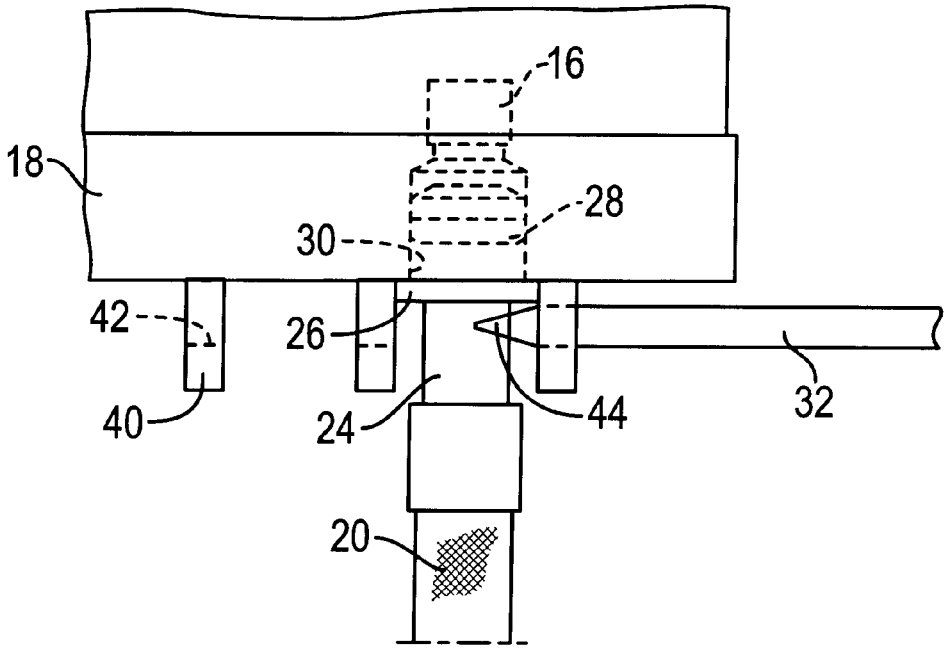
FIG. 4 shows an enlarged view of the connecting nipple of the supply line inserted in the first opening as shown in FIG. 3.
Figure 5:
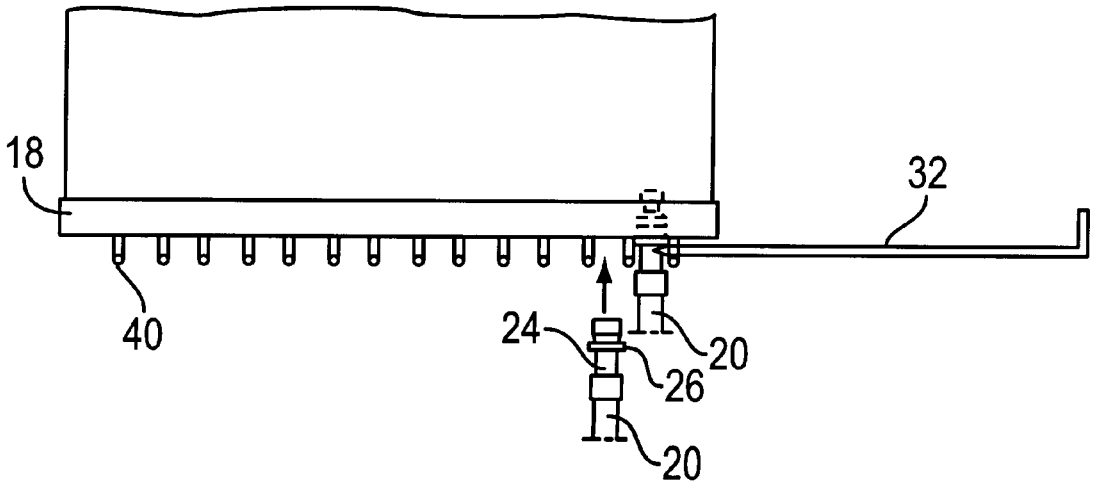
FIG. 5 shows a view of the support plate corresponding to that in FIG. 3, in which a second supply line, having a connecting nipple inserted in the second opening of the first row of openings, is locked down to the support plate.

As shown in FIGS. 3 through 5, the supply lines 20 are each equipped at the end to be connected to the support plate 18 with a connecting nipple 24. Each connecting nipple 24 has an individual stop 26 and is provided with an individual O-ring 28 surrounding the connecting nipple 24. FIG. 4 shows the connecting nipple 24 in detail. The connecting nipples 24 are to be attached to the steam lines 16 via the openings 30. The stops 26 of the connecting nipples 24 may be formed as a ring flange surrounding a corresponding connecting nipple 24. In this manner, each stop 26 can work together with two retaining strips 32 (as described below) located on opposite sides of the relevant connecting nipple 24. Where an O-ring 28 is provided for sealing each connecting nipple 24 in a corresponding opening 30, before the nipples 24 are inserted in the relevant openings 30, it is advisable for the O-rings 28 to be greased.

The connecting nipples 24 associated with the supply lines 20 are inserted into the openings or bores 30 from the underside of the support plate 18 until the stops 26 contact the underside of the plate 18. In this manner, the supply lines 20 are connected to the steam lines 16, which, as noted, are connected to each opening 30 on the upper side of the plate 18, as shown in FIGS. 3 through 5.

Finally, the supply lines 20 are locked down to the support plate 18 by retaining strips 32 working in conjunction with the stops 26, as shown in FIGS. 3 through 10. For this purpose, the retaining strips 32 are pushed in a direction parallel to the support plate 18 and from the underside of the stops 26 (e.g., behind the stops 26), causing the stops 26 to be held to the underside of the support plate 18 by the retaining strips 32.

That is, the steam blower box 10 includes a connecting nipple 24 having a stop 26 provided to each of the supply lines 20 at the end to be connected to the steam lines 16, and a support plate 18 to which the steam lines 16 are routed. The support plate 18 has openings 30 formed therein into which the connecting nipples 24 can be inserted from one side of the support plate 18 until the stops 26 contact the plate 18, while the steam lines 16 connect to the openings 30 on a remaining side of the plate 18. At least one retaining strip 32 works in conjunction with the stops 26 to lock down the supply lines 20 to the support plate 18, the retaining strip or strips 32 being movable parallel to the support plate 18 behind the stops 26, so that the stops 26 are held on the one side of the plate 18 by the retaining strip or strips 32.

As shown in FIG. 4, the retaining strips 32 are tapered at their front ends 44 in the direction of motion, in order to create a guide surface that works together with the stops 26, by means of which the connecting nipples 24 are, if necessary, pushed completely against the underside of the support plate 18. With the taper, before the connecting nipples 24 are locked down on the support plate 18 by the untapered portion of the retaining strip 32 as the retaining strip 32 is pushed along, the relevant connecting nipples 26 may be pushed further into the openings 30 until the stops 26 make contact with the support plate 18. Moreover, as shown in FIG. 3, the retaining strips are turned upward at the rear or trailing portion 34, thereby providing a limit on how far the retaining strip 32 may be pushed in, as well as an extension for securing the retaining strip 32.

In the embodiment, the supply lines 20 include flexible hoses, which are equipped, at least in part, with a durable braided covering. That is, each flexible hose may be provided along at least a portion of a length thereof with a braided covering. In the embodiment depicted in FIG. 4, the flexible hoses have no such braided covering in the region of at least one of the two ends thereof. The flexible hoses permit the supply lines 20 to be routed further, and in the embodiment, the flexible hoses hang downwardly. In order to retain maximum flexibility, for example in the vicinity of the support plate 18, the braided covering can be provided starting a certain distance away from the support plate 18.

As noted above, the O-rings 28 are installed and greased before the connecting nipples 24 are inserted in the appropriate openings 30. Subsequently, the connecting nipples 24 are each pushed far enough into the appropriate openings 30 for the associated flange stop 26 to be in direct contact with the underside of the support plate 18. The flexible supply lines 20 can then hang downwardly, and are routed to the rear of the steam distribution station or control valve station 22. In the region between the base of the paper-making machine and the control valve station 22, the supply lines 20 are installed as closely together as possible. Finally, the installed supply lines 20 can be arranged on a support frame or mounting frame. The steam lines 16 can also be arranged on a support frame or mounting frame.

In the present embodiment, the openings or bores 30 of the support plate 18 are filled with supply lines 20 one row at a time, starting with the row of openings 30 on the right side of FIG. 2, where the first opening 30 of this first row ($R_1$), located at the bottom right of FIG. 2, is filled first.

FIG. 3 shows a schematic side view of the support plate in the direction of Arrow A in FIG. 2, where a first supply line 20, having a corresponding connecting nipple 24, inserted in the first opening 30 of the first row $R_1$ of openings 30 of the support plate 18, has been locked down to the support plate 18.

Next, as shown in FIG. 4, the relevant (first) retaining strip 32 is pushed just far enough (to the left of FIG. 4) that the first supply line 20 is locked down to the support plate 18 by the retaining strip 32, but the next, i.e. the second, opening 30 of the row of openings $R_1$ remains free (i.e., not blocked by the retaining strip 32) for connecting the second supply line 20.

Subsequently, as shown in FIG. 5, the second supply line 20 is locked down to the support plate 18. First, the connecting nipple 24 of the second supply line 20 is again inserted at the underside of the support plate 18 in the second opening 30 of the first row of openings $R_1$, until the relevant stop 26 contacts the underside of the support plate 18. The (second) retaining strip 32 is again only pushed far enough so that the second supply line 20 is also locked down to the support plate 18, but the next opening 30 is kept free (i.e., not blocked by the retaining strip 32) so that the third supply line 20 can be connected.

Accordingly, the retaining strip 32 is pushed in steps, and the connecting nipples 24 associated with the first adjacent row of openings $R_1$ can be inserted one after another into succeeding openings 30 of this first row $R_1$ and locked down to the support plate 18 by the first retaining strip 32 as the first retaining strip 32 is pushed along. In other words, each of the retaining strips 32 may hold a plurality of flange stops 26 of the connecting nipples against the second (bottom) surface of the support plate 18, the number of the flange stops 26 held by each retaining strip 32 being determined by an amount of sliding in the direction of the rows $R_i$ of openings 30.

Figure 6:
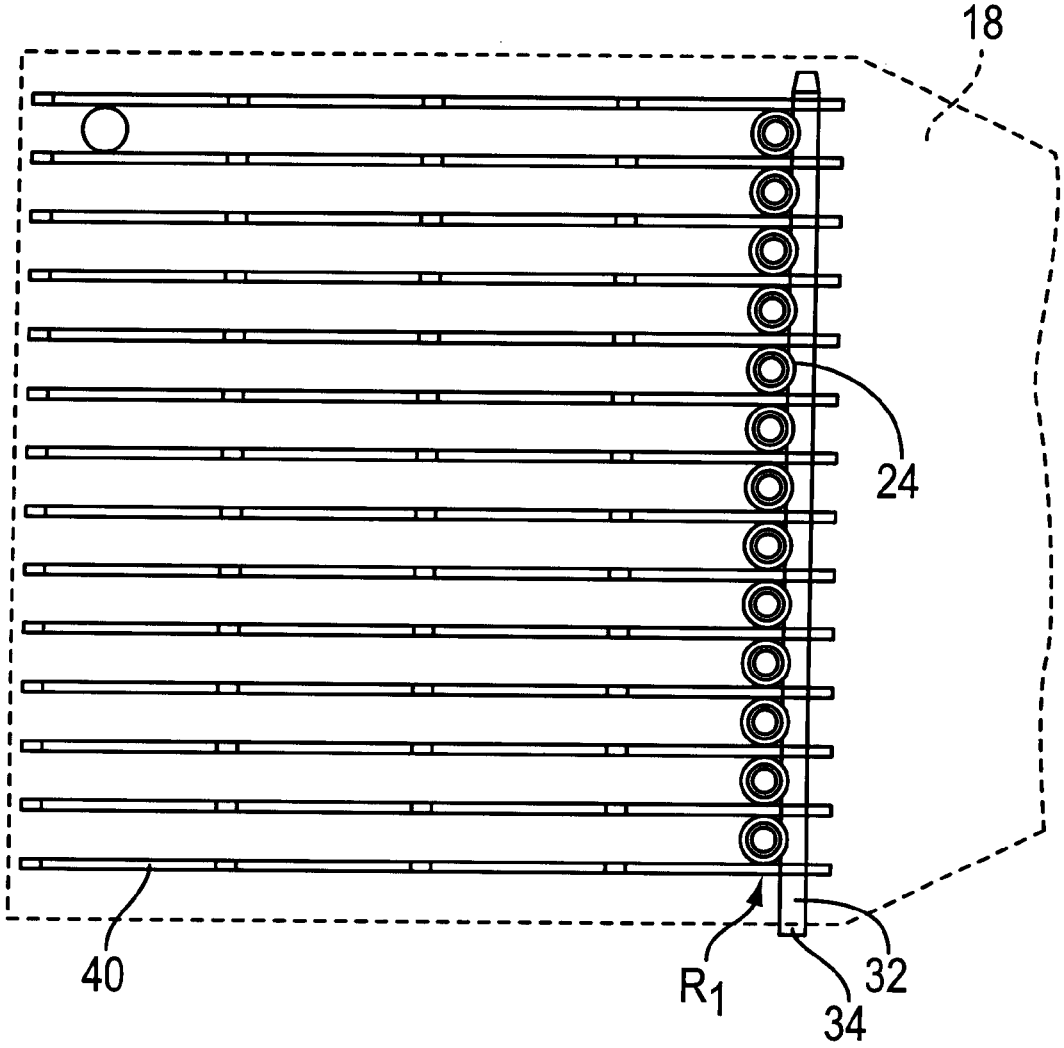
FIG. 6 shows a schematic top view of the support plate having a first row of openings filled completely with connecting nipples.

FIG. 6 shows a schematic top view of the support plate 18 having a first row of openings $R_1$ completely filled with connecting nipples 24. In FIGS. 6–9 and 11–12, the support plate 18 is indicated by a dashed phantom line, while the openings 30 are not shown. The relevant (first) retaining strip 32 is completely pushed in to a final position, extending from one side of the support plate 18 to the opposite side thereof, so that the first retaining strip 32 grips the stops 26 of all the connecting nipples 24 associated with this row ($R_1$) of openings 30, thus preventing all the connecting nipples 24 in the row ($R_1$) from slipping out of the openings 30. In the final position, a rear portion 34 of the retaining strip 32 rests against the side of the support plate 18 from which the retaining strip 32 was inserted.

Accordingly, at least some of the openings 30 provided in the support plate 18 are arranged in a row of openings 20, the retaining strip 32 being movable laterally along the row of openings 30. The connecting nipples 24 inserted in the row of openings 30 are locked down to the support plate 18 by the retaining strip 32 movable laterally along the row of openings 30. A retaining strip 32 can thus lock several supply lines 20 down to the support plate 18.

The second row $R_2$ of openings of the support plate 18 is subsequently filled with the connecting nipples 24 of the relevant supply lines 20, in the same manner as the first row $R_1$ of openings 30.

Figure 7:
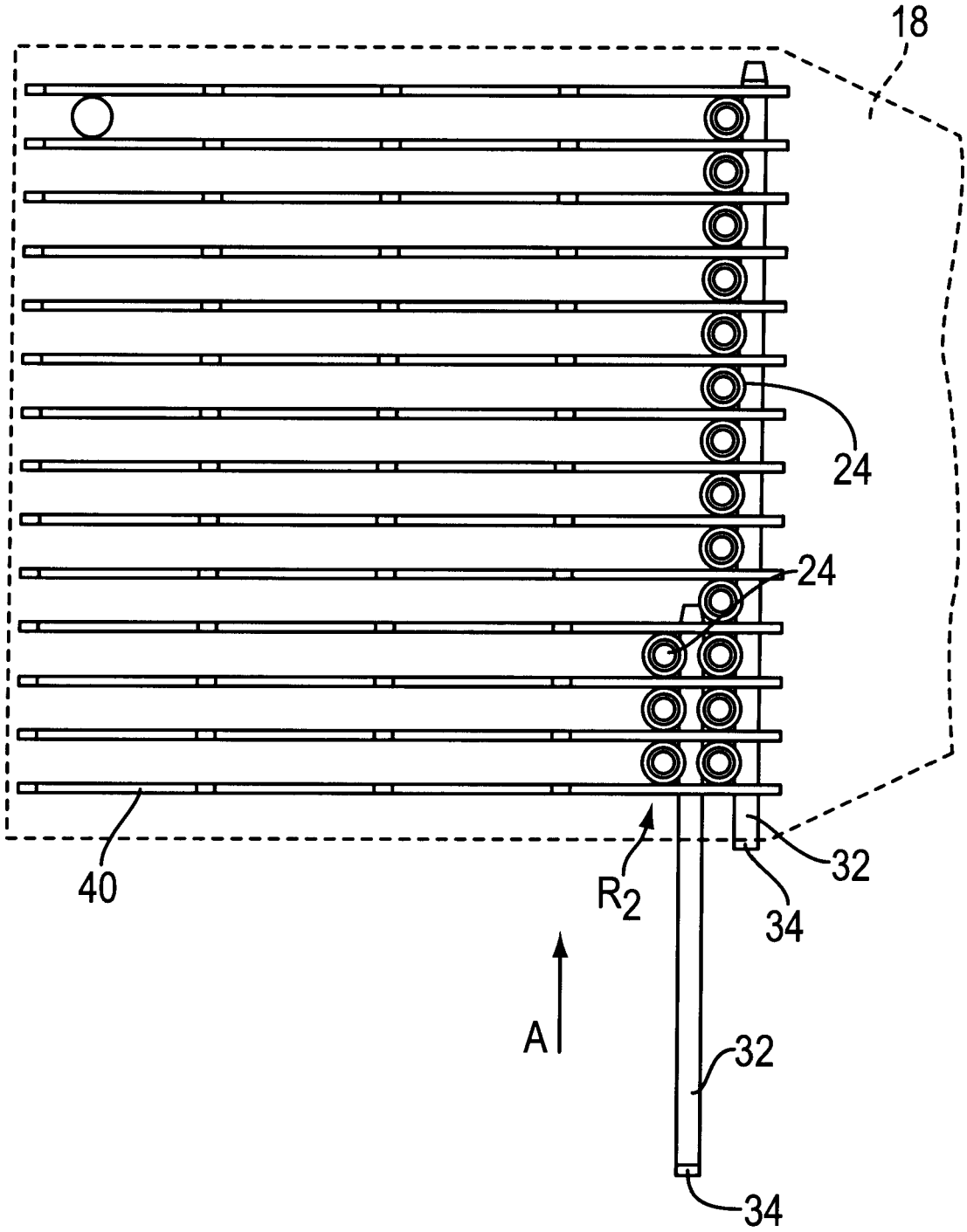
FIG. 7 shows a schematic top view of the support plate having a second row of openings partly filled with connecting nipples.

FIG. 7 shows a schematic top view of the support plate 18 in which the second row $R_2$ of openings 30 has been filled, in this case, with three connecting nipples 24 associated with supply lines 20. In order to secure the second set of connecting nipples 24, a second retaining strip 32 has been inserted between the first and second rows $R_1$ and $R_2$ of openings 30. This second retaining strip 32 is, as noted above with respect to the stepwise motion of the retaining strips 32, pushed further in steps, the connecting nipples 24 associated with the second (adjacent) row $R_2$ of openings 30 being inserted one after another into succeeding openings 30 of the second row $R_2$ and locked down to the support plate 18 by the relevant (second) retaining strip 32 as the second retaining strip 32 is pushed along.

Figure 8:
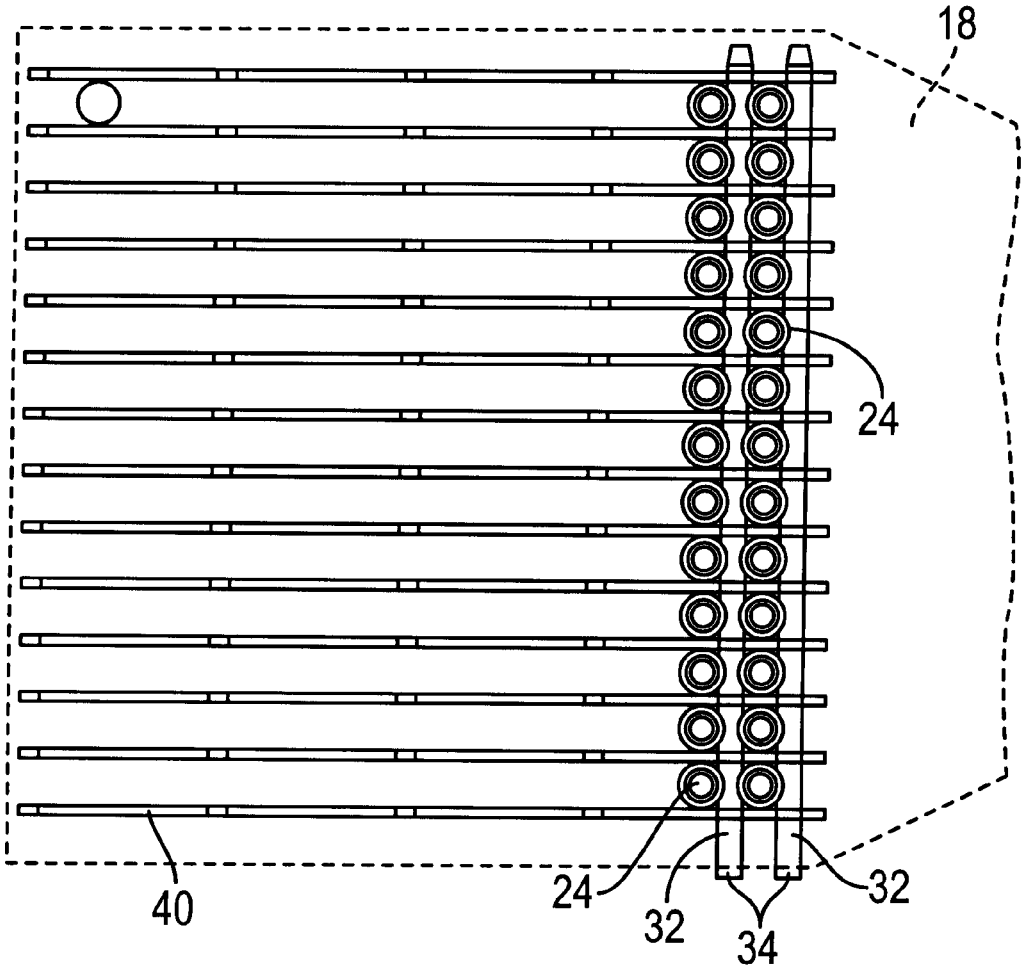
FIG. 8 shows a schematic top view of the support plate with the first and second rows of openings completely filled with connecting nipples.

FIG. 8 shows a schematic top view of the support plate 18, with the first and second rows $R_1$ and $R_2$ of openings 30 completely filled with connecting nipples 24 connected to supply lines 20. FIGS. 7 and 8 show, in detail, that the second retaining strip 32, being provided between the first and second rows $R_1$ and $R_2$ of openings 30, works together with the stops 26 (also as shown in FIGS. 3 through 5) of the connecting nipples 24 inserted in the first row $R_1$ of openings 30, as well as with the stops 26 of those in the second row $R_2$ of openings 30, to lock down both rows of connecting nipples 24 to the support plate 18. That is, the second retaining strip 32, and the remaining retaining strips 32 in rows $R_2$–$R_{10}$, hold flange stops 26 of the connecting nipples 24 on both sides of the retaining strip 32 in the direction of the columns of openings 30.

In this embodiment, the second retaining strip 32 is inserted from the same side of the support plate 18 as the first retaining strip 32, as are the following retaining strips 32. The rear end 34 of the second retaining strip 32, when moved to the final position, also rests against the relevant side of the support plate 18, as shown in FIG. 8.

Accordingly, each row $R_i$ of openings 30 is arranged with an adjacent and parallel row $R_{i+1}$ of openings (e.g., the second row $R_2$ adjacent the first row $R_1$, the third row $R_3$ adjacent the second row $R_2$, etc.). Each retaining strip 32 is moved in steps along the adjacent row $R_{i+1}$ of openings 30 such that the connecting nipples 24 associated with the adjacent row $R_{i+1}$ of openings 30 are also inserted one after another into sequential openings 30 of the adjacent row $R_{i+1}$, and are locked down to the support plate 18 by the retaining strip 32 as the retaining strip 32 is pushed along, even while the retaining strip 32 locks the second side of the connecting nipples 24 of the row $R_i$ into place.

Each of the retaining strips 32 may be moved laterally between adjacent rows ($R_i$, $R_{i+1}$) of parallel openings 30. One or more retaining strips 32 may act together with the stops 26 of corresponding connecting nipples 24 inserted into two adjacent parallel rows ($R_i$, $R_{i+1}$) of openings 30 to lock corresponding connecting nipples 24, inserted into both of two adjacent parallel rows ($R_i$, $R_{i+1}$) of openings 30, down to the support plate 18. In other words, retaining strips 32 provided between adjacent rows ($R_i$, $R_{i+1}$) of openings 30 can act together with the stops 26 of connecting nipples 24 inserted into one row $R_i$ of openings as well as with the stops 26 of the connecting nipples 24 inserted into another, adjacent row $R_{i+1}$ of openings 30 in order to lock the relevant connecting nipples 24 down to the support plate 18.

As noted above, the individual retaining strips 32 can be moved in steps in such a way that the connecting nipples 24 associated with each adjacent row $R_i$ of openings can be inserted one after another into sequential openings 30 of the row $R_i$ and locked down to the support plate 18 by the relevant retaining strip 32 as the retaining strip 32 is pushed along. That is, it is useful for, e.g., an outer row $R_1$ of openings 30 to be filled initially with connecting nipples 24 which, at first, are only locked down to the support plate 18 by the relevant outer retaining strip 32. While the second row $R_2$ of openings 30 is being filled, another retaining strip 32 is pushed in, which then serves to lock the connecting nipples 24 in both adjacent rows $R_1$, $R_2$ of openings 30. The same procedure applies to all the adjacent rows $R_i$, $R_{i+1}$.

Figure 9:
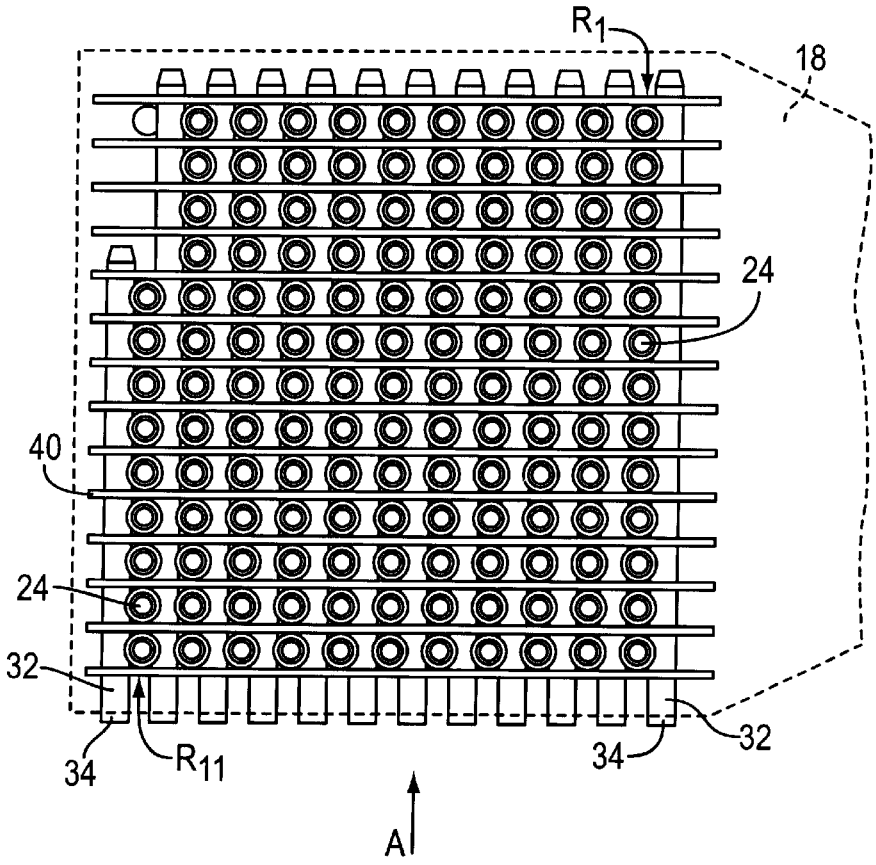
FIG. 9 shows a schematic top view of the support plate with all rows of openings filled with connecting nipples.

The subsequent rows of openings $R_3$–$R_{11}$ of the support plate 18 are also filled, in the manner described above (e.g., each retaining strip 32 securing connecting nipples 24 in a stepwise fashion as the retaining strip 32 is pushed along). FIG. 9 shows a schematic top view of the support plate 18 in which all rows of openings $R_1$–$R_{11}$ are filled appropriately, and in which all of the connecting nipples 24 are secured by retaining strips 32. In other words, the openings 30 provided in the support plate 18 are arranged in a plurality of parallel rows $R_i$ and a plurality of retaining strips 32 are provided. Each of the retaining strips 32 is movable laterally along the row of openings 30, and the connecting nipples 24 inserted in the rows $R_i$ of openings 32 are locked down to the support plate 18 by the plurality of retaining strips 32, each movable laterally along the plurality of parallel rows of openings 30.

As shown in FIG. 9, there may be two outermost retaining strips 32, one of the two outermost retaining strips 32 being moved laterally outside each outermost row (e.g., $R_1$ and $R_{11}$) of parallel openings 30. That is, at least one retaining strip 32, that can be moved parallel to the rows $R_i$ of openings 30, is provided laterally outside each of the outermost rows (e.g., $R_1$ and $R_{11}$) of openings 30, as well as between adjacent rows of openings $R_i$ and $R_{i+1}$.

In the embodiment, while the first ten rows of openings $R_1$–$R_{10}$ each have thirteen openings 30, the eleventh row of openings $R_{11}$ has only nine such openings 30, as shown in, particularly, FIGS. 2 and 9. Accordingly, the final retaining strip 32 on the outer left is shorter than the remaining retaining strips 32.

Figure 10:
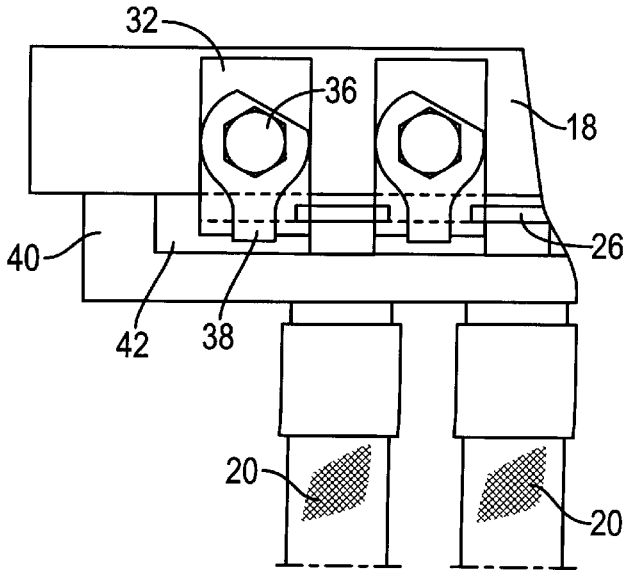
FIG. 10 shows a schematic side view of the completely filled support plate in the direction of Arrow A in FIG. 9, with retaining strips secured in their final positions.

FIG. 10 shows a schematic side view of the completely filled support plate 18, in the direction of Arrow A in FIG.

9, with the retaining strips 32 secured in their final positions. In the embodiment, as shown in FIG. 10, the retaining strips 32 are secured to the support plate 18 by screws 36 and safety plates 38 in their final positions, i.e., in positions securing the connecting nipples 24 inserted in all of the openings 30 of the rows $R_i$ of openings 30. Moreover, in the present embodiment, a total of 138 flexible supply lines 20 can be connected to the support plate 18, which are locked to the support plate 18 by a total of twelve retaining strips 32.

The retaining strips 32 can each be guided by one or more guide elements. If more than one guide element is provided, the guide elements are arranged one behind the other in the direction of motion of the retaining strips 32. In this case, it is advantageous that one such guide element is provided between each column of adjacent openings 30 of the support plate 18.

In the present embodiment, as shown in FIGS. 3–5 and 10 in particular, the guide elements are formed by crosspieces 40 that are parallel to one another and extend perpendicularly to the direction of motion of the retaining strips 32, and have guide openings 42 aligned with one another in the direction in which the relevant retaining strips 32 move.

That is, advantageously, the support plate 18 includes a guiding mechanism that guides the plurality of retaining strips 32 on the support plate 18. In this case, the guide mechanism may includes a plurality of guide elements (e.g., crosspieces 40) arranged one behind the other in the direction of motion of the plurality of retaining strips 32, and each of the plurality of retaining strips 32 is guided by the plurality of guide elements 40. Further, the plurality of guide elements (e.g., crosspieces 40) may located between each pair of openings 30 in sequence along the direction of motion of the plurality of retaining strips 32, e.g., between each column of openings 30.

In other words, several guide elements can be arranged on the support plate 18, one behind the other in the direction of the retaining strips' motion, and one such guide element 40 is advantageously located between each pair of sequential openings 30 intended for the connecting nipples 24. Each of the plurality of guide elements may include a crosspiece 40, each crosspiece 40 extending perpendicularly to the direction of motion of the plurality of retaining strips 32 and parallel to each remaining crosspiece 40, and each crosspiece 40 having a plurality of guide openings 42 formed therein. Each guide opening 42 is aligned with corresponding guide openings 42 in the remaining crosspieces 40 in the direction of motion of the plurality of retaining strips 32. That is, the guide openings 42 are aligned with one another in the direction in which the relevant retaining strips 32 move.

Accordingly, a steam blower box 10 for the application of steam onto a material web W has a plurality of steam lines 16 to be connected to a corresponding plurality of supply lines 20 connected to a steam source. The steam blower box 10 includes a support plate 18 having a first (e.g., top) and second (e.g., bottom) surface, the support plate 18 having openings 30 formed therein arranged in rows $R_i$ and columns, the number of openings 30 corresponding to the number of steam lines 16 and the number of supply lines 20, and each of the steam lines 16 being connected to a corresponding opening 30 on the first surface of the support plate 18. A plurality of guide members (e.g., crosspieces 40) extend in a direction of the columns of openings 30, each guide member having a plurality of sliding guides (e.g., guide openings 42) formed therethrough, the plurality of sliding guides of each guide member being aligned along a direction of the rows $R_i$ of openings 30. A connecting nipple 24 is provided to each of the supply lines 20, each connecting nipple 24 being insertable into the openings 30 from the second surface of the support plate 18, and each connecting nipple 24 having a flange stop 26 formed thereon. A plurality of retaining strips 32 hold the flange stops 26 of the connecting nipples 24 against the second surface of the support plate 18, and thereby hold the connecting nipples 24 in the openings from the second surface of the support plate 18. Each retaining strip 32 corresponds to a sliding guide (e.g., to a guide opening 42) and is slidable in the direction of the rows of openings 30, into the aligned sliding guides, through the plurality of guide members.

The present invention may also be expressed as a process or method, in which the supply lines 20 are connected to the rows of openings Ri in the support plate 18 of a steam blower box 10 by inserting a connecting nipple 24 of each supply line 20 into an opening 30 in a row of openings 30 until the flange stop 26 of the connecting nipple 24 contacts a surface of the support plate 18. The retaining strip 32 is slid then parallel to the row of openings 30 and parallel to the surface of the support plate 18 behind the flange stop 26 to lock the connecting nipple 24 against the support plate 18. A next connecting nipple 24 of a next supply line 20 is again inserted in a next opening 30 in the row until a flange stop 26 of the next connecting nipple 24 contacts the surface of the support plate 18, and the retaining strip 32 is further slid behind the flange stop 26 of the next connecting nipple 24 to lock the next connecting nipple 24 against the support plate 18. The inserting of a next connecting nipple and the sliding of the retaining strip are repeated, in stepwise fashion, until all of the openings 30 in the row of openings 30 are filled with connecting nipples 24 locked against the support plate 18 by the retaining strip 32.

In the method, at least one retaining strip 32 may be slid between two adjacent parallel rows ($R_i$, $R_{i+1}$) of openings 30 with connecting nipples 24 inserted therein so that the retaining strip 32 locks the connecting nipples 24 against the support plate 18 in both of the two adjacent parallel rows ($R_i$, $R_{i+1}$) of openings 30. Further, a retaining strip 32 may be slid along each of two sides of every row of a plurality of parallel rows $R_i$ of openings 30 with connecting nipples 24 inserted therein so that a plurality of retaining strips 32 lock the connecting nipples 24 against the support plate on two sides of every row.

Figure 11:
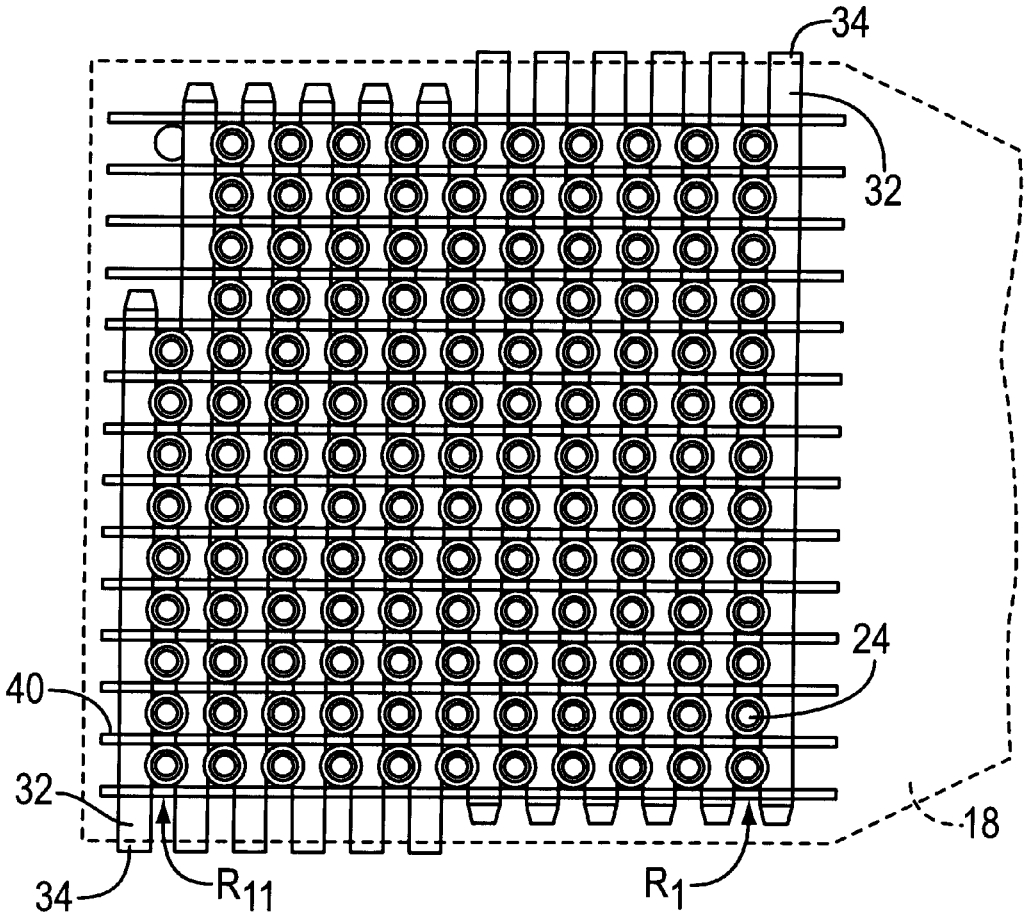
FIG. 11 shows a schematic top view of an alternative embodiment of the steam blower box with all rows of openings filled with connecting nipples, in which retaining strips are inserted from opposite sides of the support plate.

In FIG. 9, each of the plurality of retaining strips 32 is slidable into the aligned sliding guides (guide openings 42) through the plurality of guide members (crosspieces 40) in the direction of the rows of openings $R_1$–$R_{11}$ from a same side of the support plate 18. However, FIG. 11 shows a schematic top view of the support plate 18 in an alternative embodiment, in which all rows of openings $R_1$–$R_{11}$ are filled appropriately and all connecting nipples 24 are secured by retaining strips 32, but one or more retaining strips are slidable into the aligned sliding guides (guide openings 42) through the guide members (crosspieces 40) in the direction of the rows of openings $R_1$–$R_{11}$ from one side of the support plate 18, while one or more remaining retaining strips 32 are slidable into the aligned sliding guides through the guide members in the direction of the rows of openings $R_1$–$R_{11}$ from another, opposite side of the support plate 18. That is, in FIG. 11, six retaining strips 32 in a group are inserted from one side of the support plate 18, and another six retaining strips 32 in another group are inserted from the opposite side of the support plate 18.

Figure 12:
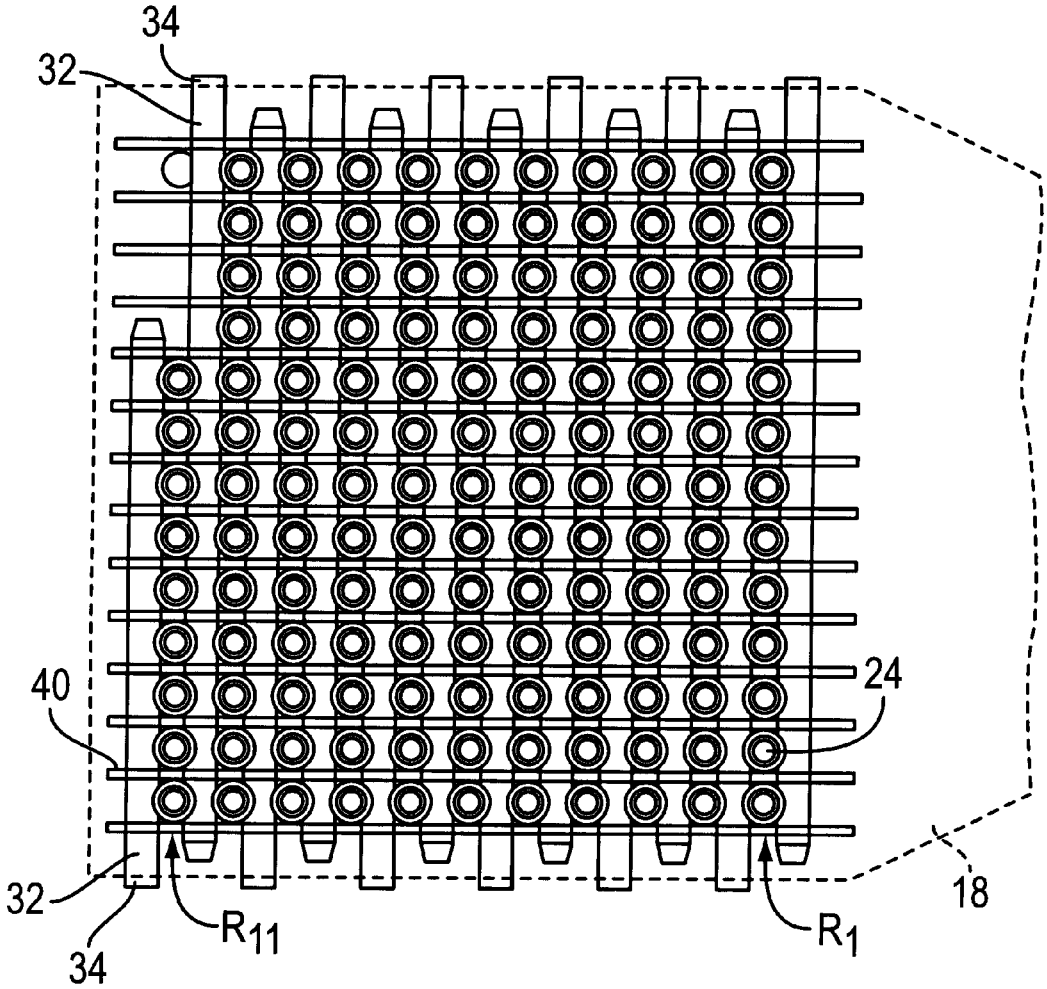
FIG. 12 shows a schematic top view of a second alternative embodiment of the steam blower box with all rows of openings filled with connecting nipples, in which retaining strips are alternately inserted from opposite sides of the support plate.

FIG. 12 shows a second alternative embodiment, in which one or more retaining strips 32 are slidable into the aligned sliding guides (guide openings 42) through the guide members (crosspieces 40) in the direction of the rows of openings $R_1$–$R_{11}$ from one side of the support plate 18, while one or more remaining retaining strips 32 are slidable into the aligned sliding guides through the guide members in the direction of the rows of openings $R_1$–$R_{11}$ from another, opposite side of the support plate 18. That is, in FIG. 12, six retaining strips 32 inserted from one side of the support plate 18 alternate with another six retaining strips 32 inserted from the opposite side of the support plate 18.

That is, as shown in FIG. 9, each of the plurality of retaining strips 32 may be are moved into respective locking positions from the same side of the support plate 18. Alternatively, as shown in FIGS. 11 and 12, the retaining strips 32 can be pushed into their respective locking positions from opposite sides of the support plate 18. In other words, as shown in FIGS. 11 and 12, one or more retaining strips 32 is moved into a respective locking position from one side of the support plate 18, and one or more remaining retaining strips 32 is moved into a respective locking position from another, opposite side of the support plate 18.

Although the present invention has been described herein with reference to particular means, materials and embodiments, it is understood that the words which have been used herein are words of description and illustration, rather than words of limitation. The present invention is not intended to be limited to the particulars disclosed herein; rather, the present invention extends to all functionally equivalent and/or insubstantially different structures, such as are within the scope of the appended claims. Changes may be made, within the purview of the appended claims, as presently stated and as amended, without departing from the scope and spirit of the present invention in its aspects.

What is claimed is:

1. A steam blower box for the application of steam onto a material web to be dewatered passing through a press section of a paper-making machine, said steam blower box comprising:

a blower box extending, transverse to a web travel direction of the material web, over an entire width of the material web, said blower box comprising a plurality of zone chambers, arranged side by side over the width of the web, and connected to a plurality of steam lines, said plurality of steam lines to be connected to a corresponding plurality of supply lines connected to a steam source;

a connecting nipple having a stop provided to each of the supply lines at ends of the supply lines to be connected to the steam lines;

a support plate to which said plurality of steam lines is routed, said support plate having openings formed therein into which said connecting nipples can be inserted from one side of said support plate until said stops contact said one side of the plate, said steam lines connecting to said openings on a remaining side of the plate; and at least one retaining strip which works in conjunction with the stops to lock down the supply lines to the support plate, said at least one retaining strip being movable parallel to said support plate behind said stops so that said stops are held on said one side of the plate by said at least one retaining strip.

2. The steam blower box according to claim 1, wherein said retaining strip is tapered on a front end in a direction of motion thereof.

3. The steam blower box according to claim 1, wherein at least some of said openings provided in the support plate are arranged in at least one row of openings, said at least one retaining strip is movable laterally along said row of openings, and said connecting nipples inserted in said row of openings being locked down to the support plate by said at least one retaining strip movable laterally along said row of openings.

4. The steam blower box according to claim 3, wherein said at least one row of openings is arranged with an adjacent row of openings, said adjacent row parallel to said at least one row; and said at least one retaining strip is moved in steps along said adjacent row of openings such that said connecting nipples associated with said adjacent row of openings are inserted one after another into sequential openings of said adjacent row and locked down to said support plate by the said retaining strip as said retaining strip is pushed along.

5. The steam blower box according to claim 1, wherein said openings provided in the support plate are arranged in a plurality of parallel rows and wherein said at least one retaining strip comprises a plurality of retaining strips, each of said plurality of retaining strips being movable laterally along said row of openings, and said connecting nipples inserted in said row of openings being locked down to the support plate by said plurality of retaining strips movable laterally along said plurality of parallel rows of openings.

6. The steam blower box according to claim 5, wherein each of said plurality of retaining strips is moved laterally between adjacent rows of said plurality of parallel openings, and at least one of said plurality of retaining strips acts together with the stops of corresponding connecting nipples inserted into two adjacent parallel rows of openings to lock corresponding connecting nipples inserted into both of said two adjacent parallel rows of openings down to the support plate.

7. The steam blower box according to claim 6, said plurality of retaining strips further comprising:

two outermost retaining strips, one of said two outermost retaining strips being moved laterally outside each outermost row of said plurality of parallel openings.

8. The steam blower box according to claim 5, wherein each of said plurality of retaining strips are moved into respective locking positions from the same side of said support plate.

9. The steam blower box according to claim 5, wherein at least one retaining strip of said plurality of retaining strips is moved into a respective locking position from one side of said support plate, and at least one remaining retaining strip of said plurality of retaining strips is moved into a respective locking position from another side of said support plate opposite said one side.

10. The steam blower box according to claim 5, wherein said support plate comprises a guiding mechanism that guides said plurality of retaining strips on the support plate.

11. The steam blower box according to claim 10, wherein said guide mechanism comprises a plurality of guide elements arranged one behind the other in the direction of motion of said plurality of retaining strips, each of said plurality of retaining strips being guided by said plurality of guide elements.

12. The steam blower box according to claim 11, wherein said plurality of guide elements are located between each pair of openings in sequence along said direction of motion of said plurality of retaining strips.

13. The steam blower box according to claim 11, wherein each of said plurality of guide elements comprises a crosspiece, each crosspiece extending perpendicularly to said direction of motion of said plurality of retaining strips and parallel to each remaining crosspiece, and each crosspiece having a plurality of guide openings formed therein, each guide opening being aligned with corresponding guide openings in each remaining crosspiece in said direction of motion of said plurality of retaining strips.

14. The steam blower box according to claim 1, wherein each said stop of said connecting nipples is formed as a ring flange surrounding a corresponding connecting nipple.

15. The steam blower box according to claim 1, wherein each said connecting nipple is provided with at least one O-ring for sealing each said connecting nipple in a corresponding opening.

16. The steam blower box according to claim 1, wherein said support plate is substantially horizontally oriented and said connecting nipples are inserted into said openings from an underside of said support plate.

17. The steam blower box according to claim 1, wherein each of said supply lines comprises a flexible hose.

18. The steam blower box according to claim 17, wherein each flexible hose is provided along at least a portion of a length thereof with a braided covering.

19. The steam blower box according to claim 1, wherein said supply lines, at ends facing away from said support plate, are connected to a steam distribution station having control valves controlling an amount of steam to each said supply line.

20. The steam blower box according to claim 3, wherein said at least one retaining strip is secured, by a screw and a safety plate, to said support plate in a position securing said connecting nipples inserted in all of said openings of said row of openings.

21. The steam blower box according to claim 1, wherein said support plate extends away from one end of the steam blower box to a position outside of the paper-making machine.

22. The steam blower box according to claim 1, wherein the material web is one of a paper web or a cardboard web.

23. A steam blower box for the application of steam onto a material web, said steam blower box having a plurality of steam lines to be connected to a corresponding plurality of supply lines connected to a steam source, comprising:

a support plate having a first and second surface, said support plate having openings formed therein arranged in rows and columns, the number of openings corresponding to the number of steam lines and the number of supply lines, and each of the steam lines being connected to a corresponding opening on the first surface of the support plate;

a plurality of guide members extending in a direction of said columns of openings, each guide member having a plurality of sliding guides formed therethrough, said plurality of sliding guides of each guide member being aligned along a direction of said rows of openings;

a connecting nipple provided to each of the supply lines, each said connecting nipple being insertable into said openings from said second surface of said support plate, and each said connecting nipple having a flange stop formed thereon; and a plurality of retaining strips that hold said flange stops of said connecting nipples against said second surface of said support plate and thereby hold said connecting nipples in said openings from said second surface of said support plate, each retaining strip corresponding to a sliding guide and being slidable in said direction of said rows of openings into said aligned sliding guides through said plurality of guide members.

24. The steam blower box according to claim 23, each of said plurality of retaining strips holding a plurality of flange stops of said connecting nipples against said second surface of said support plate, a number of said flange stops held by each of said plurality of retaining strips being determined by an amount of sliding in said direction of said rows of openings.

25. The steam blower box according to claim 23, at least one of said plurality of retaining strips holding flange stops of said connecting nipples on both sides of said at least one of said plurality of retaining strips in said direction of said columns of openings.

26. The steam blower box according to claim 23, each of said plurality of retaining strips being slidable into said aligned sliding guides through said plurality of guide members in said direction of said rows of openings from a same side of said support plate.

27. The steam blower box according to claim 23, at least one retaining strip of said plurality of retaining strips being slidable into said aligned sliding guides through said plurality of guide members in said direction of said rows of openings from one side of said support plate, and at least one remaining retaining strip of said plurality of retaining strips being slidable into said aligned sliding guides through said plurality of guide members in said direction of said rows of openings from another side of said support plate opposite said one side.

28. A method of connecting steam supply lines to rows of openings in a support plate of a steam blower box, comprising:

inserting a connecting nipple of a steam supply line into an opening in a row of openings until a flange stop of the connecting nipple contacts a surface of the support plate;

sliding a retaining strip parallel to the row of openings and parallel to the surface of the support plate behind the flange stop to lock the connecting nipple against the support plate;

inserting a next connecting nipple of a next steam supply line in a next opening in the row of openings until a flange stop of the next connecting nipple contacts the surface of the support plate;

further sliding the retaining strip behind the flange stop of the next connecting nipple to lock the next connecting nipple against the support plate; and repeating said inserting a next connecting nipple and said further sliding the retaining strip, in stepwise fashion, until all of the openings in said row of openings are filled with connecting nipples locked against the support plate by the retaining strip.

29. The method according to claim 28, wherein at least one retaining strip is slid between two adjacent parallel rows of openings with connecting nipples inserted therein so that said at least one retaining strip locks said connecting nipples against the support plate in both of said two adjacent parallel rows of openings.

30. The method according to claim 29, wherein a plurality of retaining strips are provided, and one retaining strip is slid along each of two sides of every row of a plurality of parallel rows of openings with connecting nipples inserted therein, so that said plurality of retaining strips lock said connecting nipples against said support plate on said two sides of every row of said parallel rows of openings.

* * * * *

UNITED STATES PATENT AND TRADEMARK OFFICE

CERTIFICATE OF CORRECTION

PATENT NO. : 6,178,661 B1
DATED : January 30, 2001
INVENTOR(S) : Dieter Müller et al.

It is certified that error appears in the above-identified patent and that said Letters Patent is hereby corrected as shown below:

Title page,
Item [30], Foreign Application Priority Data, add:
-- May 26, 1998 [DE] Germany ..... 298 09 466.5 --

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*